US008702968B2

(12) United States Patent
Boons

(10) Patent No.: US 8,702,968 B2
(45) Date of Patent: Apr. 22, 2014

(54) LOW VISCOSITY MARINE CYLINDER LUBRICATING OIL COMPOSITIONS

(75) Inventor: Cornelis Hendrikus Maria Boons, Prinsenbeek (NL)

(73) Assignee: Chevron Oronite Technology B.V., Rotterdam (NL)

( * ) Notice: Subject to any disclaimer, the term of this patent is extended or adjusted under 35 U.S.C. 154(b) by 0 days.

(21) Appl. No.: 13/438,978

(22) Filed: Apr. 4, 2012

(65) Prior Publication Data

US 2012/0322701 A1 Dec. 20, 2012

Related U.S. Application Data

(60) Provisional application No. 61/516,583, filed on Apr. 5, 2011.

(51) Int. Cl.
*C10G 71/00* (2006.01)
*C10M 169/04* (2006.01)

(52) U.S. Cl.
USPC ..... 208/19; 508/110

(58) Field of Classification Search
USPC ..... 508/110; 208/19
See application file for complete search history.

(56) References Cited

U.S. PATENT DOCUMENTS

| | | | |
|---|---|---|---|
| 3,036,003 | A | 5/1962 | Verdol |
| 3,172,892 | A | 3/1965 | Le Suer |
| 3,219,666 | A | 11/1965 | Norman et al. |
| 3,272,746 | A | 9/1966 | Le Suer et al. |
| 3,275,554 | A | 9/1966 | Wagenaar |
| 3,329,658 | A | 7/1967 | Fields |
| 3,438,757 | A | 4/1969 | Honnen et al. |
| 3,449,250 | A | 6/1969 | Fields |
| 3,454,555 | A | 7/1969 | van der Voort et al. |
| 3,565,804 | A | 2/1971 | Honnen et al. |
| 3,586,629 | A | 6/1971 | Otto et al. |
| 3,591,598 | A | 7/1971 | Traise et al. |
| 3,666,730 | A | 5/1972 | Coleman |
| 3,980,569 | A | 9/1976 | Pindar et al. |
| 4,234,435 | A | 11/1980 | Meinhardt et al. |
| 4,612,132 | A | 9/1986 | Wollenberg et al. |
| 4,746,446 | A | 5/1988 | Wollenberg et al. |
| 4,943,672 | A | 7/1990 | Hamner et al. |
| 5,059,299 | A | 10/1991 | Cody et al. |
| 5,716,912 | A | 2/1998 | Harrison et al. |
| 5,733,839 | A | 3/1998 | Espinoza et al. |
| 6,165,235 | A | 12/2000 | Kolp et al. |
| 6,339,051 | B1 | 1/2002 | Carey et al. |
| 6,440,905 | B1 | 8/2002 | Epps et al. |
| 7,018,525 | B2 | 3/2006 | Miller et al. |
| RE39,073 | E | 4/2006 | Herbolzheimer et al. |
| 7,083,713 | B2 | 8/2006 | Abernathy et al. |
| 2001/0003734 | A1 * | 6/2001 | Dunn ..... 508/197 |
| 2004/0159582 | A1 | 8/2004 | Simmons et al. |
| 2005/0077208 | A1 | 4/2005 | Miller et al. |
| 2005/0133407 | A1 | 6/2005 | Abernathy et al. |
| 2005/0133409 | A1 | 6/2005 | Abernathy et al. |
| 2005/0139513 | A1 | 6/2005 | Miller |
| 2005/0139514 | A1 | 6/2005 | Miller |
| 2005/0227866 | A1 | 10/2005 | Berge et al. |
| 2005/0241990 | A1 | 11/2005 | Ziemer et al. |
| 2005/0261145 | A1 | 11/2005 | Rosenbaum et al. |
| 2005/0261146 | A1 | 11/2005 | Rosenbaum et al. |
| 2005/0261147 | A1 | 11/2005 | Rosenbaum et al. |
| 2006/0013210 | A1 | 1/2006 | Bordogna et al. |
| 2006/0016721 | A1 | 1/2006 | Miller et al. |
| 2006/0016724 | A1 | 1/2006 | Miller et al. |
| 2006/0020185 | A1 | 1/2006 | Al-Ali |
| 2006/0076267 | A1 | 4/2006 | Miller et al. |
| 2006/0201851 | A1 | 9/2006 | Rosenbaum et al. |
| 2006/0289337 | A1 | 12/2006 | Rosenbaum et al. |
| 2007/0238628 | A1 | 10/2007 | Haire et al. |
| 2008/0073248 | A1 | 3/2008 | Shah et al. |
| 2008/0153721 | A1 | 6/2008 | Rosenbaum et al. |
| 2008/0153723 | A1 | 6/2008 | Boons et al. |
| 2009/0111936 | A1 | 4/2009 | Wedlock |
| 2009/0203835 | A1 | 8/2009 | Null et al. |
| 2010/0323936 | A1 | 12/2010 | Ames et al. |

FOREIGN PATENT DOCUMENTS

| | | |
|---|---|---|
| EP | 668342 | 8/1999 |
| EP | 776959 | 10/2004 |
| EP | 1752514 | 2/2007 |
| EP | 1967571 | 9/2008 |
| EP | 2189515 | 5/2010 |
| WO | 99/20720 | 4/1999 |
| WO | 99/34917 | 7/1999 |
| WO | 2005/107935 | 11/2005 |
| WO | WO2008021737 | 2/2008 |
| WO | 2010/066860 | 6/2010 |
| WO | KR1020110033900 | 4/2011 |

OTHER PUBLICATIONS

Briant et al. "Rheological Properties of Lubricants" Editions Technip, Paris, 1969, pp. 238-239.

R.J. Prince "Base oils from petroleum" Chemistry and Technology of Lubricants, Second edition, 1997, pp. 18-21.

Deckman et al "Automotive Pros and Cons" Hart's Lubricant World, Sep. 1997, pp. 27-28.

* cited by examiner

*Primary Examiner* — Vishal Vasisth

(57) ABSTRACT

Disclosed herein are marine cylinder lubricants which comprise a major amount of basestock selected from the group consisting of a Group II basestock, a Group III basestock and mixtures thereof, wherein the marine cylinder lubricant has a kinematic viscosity at 100° C. of from 13 to about 16.2 cSt; and contains less than about 10 wt. % bright stock. Also disclosed are marine cylinder lubricants which comprise a major amount of basestock selected from the group consisting of a Group II basestock, a Group III basestock and mixtures thereof, wherein the marine cylinder lubricant has a kinematic viscosity at 100° C. of between about 13 and about 16.2 cSt; and a total base number of 5 to about 70, and further wherein the marine cylinder lubricant contains less than about 10 wt. % bright stock.

6 Claims, No Drawings

LOW VISCOSITY MARINE CYLINDER LUBRICATING OIL COMPOSITIONS

PRIORITY

This application claims the benefit under 35 U.S.C. §119 to U.S. Provisional Patent Application No. 61/516,583, filed on Apr. 5, 2011, the contents of which are incorporated by reference herein.

BACKGROUND OF THE INVENTION

1. Technical Field

The present invention generally relates to low viscosity marine cylinder lubricating oil compositions.

2. Description of the Related Art

In the not so distant past, rapidly escalating energy costs, particularly those incurred in distilling crude oil and liquid petroleum, became burdensome to the users of transportation fuels, such as owners and operators of seagoing ships. In response, those users have steered their operations away from steam turbine propulsion units in favor of large marine diesel engines that are more fuel efficient. Diesel engines may generally be classified as slow-speed, medium-speed, or high-speed engines, with the slow-speed variety being used for the largest, deep shaft marine vessels and certain other industrial applications.

Slow-speed diesel engines are unique in size and method of operation. The engines themselves are massive, the larger units may approach 200 tons in weight and an upward of 10 feet in length and 45 feet in height. The output of these engines can reach as high as 100,000 brake horsepower with engine revolutions of 60 to about 200 revolutions per minute. They are typically of crosshead design and operate on the two-stroke cycle.

Medium-speed engines, on the other hand, typically operate in the range of about 250 to about 1100 rpm and may operate on either the four-stroke or the two-stroke cycle. These engines can be of trunk piston design or occasionally of crosshead design. They typically operate on residual fuels, just like the slow-speed diesel engines, but some may also operate on distillate fuels that contain little or no residue. These engines can also be used for propulsion, ancillary applications or both on deep-sea vessels.

Slow- and medium-speed diesel engines are also extensively used in power plant operations. A slow- or medium-speed diesel engine that operates on the 2-stroke cycle is typically a direct-coupled and direct-reversing engine of crosshead construction, with a diaphragm and one or more stuffing boxes separating the power cylinders from the crankcase to prevent combustion products from entering the crankcase and mixing with the crankcase oil. The notable complete separation of the crankcase from the combustion zone has led persons skilled in the art to lubricate the combustion chamber and the crankcase with different lubricating oils.

Accordingly, in large diesel engines of the cross-head type used in marine and heavy stationary applications, the cylinders are lubricated separately from the other engine components. The cylinders are lubricated on a total loss basis with the cylinder oil being injected separately to quills on each cylinder by means of lubricators positioned around the cylinder liner. Oil is distributed to the lubricators by means of pumps, which are, in modern engine designs, actuated to apply the oil directly onto the rings to reduce wastage of the oil.

The high stresses encountered in these engines and the use of residual fuels creates the need for lubricants with a high detergency and neutralizing capability even though the oils are exposed to thermal and other stresses only for short periods of time. Residual fuels commonly used in these diesel engines typically contain significant quantities of sulfur, which, in the combustion process, combine with water to form sulfuric acid, the presence of which leads to corrosive wear. In particular, in two-stroke engines for ships, areas around the cylinder liners and piston rings can be corroded and worn by the acid. Therefore, it is important for diesel engine lubricating oils to have the ability to resist such corrosion and wear.

Accordingly, a primary function of marine cylinder lubricants is to neutralize sulfur-based acidic components of high-sulfur fuel oil combusted in slow-speed 2-cycle crosshead diesel engines. This neutralization is accomplished by the inclusion in the marine cylinder lubricant of basic species such as metallic detergents. Unfortunately the basicity of the marine cylinder lubricant can be diminished by oxidation of the marine cylinder lubricant (caused by the thermal and oxidative stress the lubricant undergoes in the engine), thus decreasing the lubricant's neutralization ability. The oxidation can be accelerated if the marine cylinder lubricants contain oxidation catalysts such as wear metals that are generally known to be present in the lubricant during engine operation.

Typically, marine cylinder lubricants for use in marine diesel engines have a viscosity in the range of 16.5 to 25 centistokes (cSt) at 100° C. In order to formulate such a lubricant, a brightstock is combined with a low viscosity oil, e.g., an oil having a viscosity from 4 to 6 cSt at 100° C. However, supplies of bright stock are dwindling and therefore bright stock cannot be relied upon to increase the viscosity of marine cylinder lubricants to the range of 16.5 to 25 cSt at 100° C. that manufacturers recommend. In addition, Hart's Lubricant World, September 1997, pp. 27-28, (referenced in EP 1967571) discloses that "Due to low-operating speeds and high loads in marine engines, high viscosity oils (SAE 40, 50, and 60) typically are required. Because hydrocracking results in a viscosity loss of the base stocks, marine oils cannot generally be formulated solely with hydrocracked base stocks, but require the use of significant amounts of bright stock. However, the use of bright stock is not desirable because of the presence of oxidatively unstable aromatics."

One solution to this problem is to use thickeners such as polyisobutylene or viscosity index improver compounds such as olefin colopymers to thicken the marine cylinder lubricants. However, these materials add to the cost of the marine cylinder lubricants. Another solution is to use lower viscosity marine cylinder lubricants; but the wear performance of low viscosity MCLs has not been well investigated.

European Patent Application Publication No. EP 1 967 571 ("the '571 application") discloses a liquid lubricant base oil composition useful in marine engine applications, such as in 2-stroke marine diesel engine cylinder oils, 2-stroke marine diesel engine system oils, and 4-stroke marine diesel engine crankcase lubricants. The lubricant base oil composition disclosed in the '571 application contains (a) a base stock comprising at least 95 wt. % saturated hydrocarbons, and (b) 0.2 to 30 wt. % of an aromatic (bright stock) extract. The '571 application further discloses that the liquid lubricant base oil composition has a viscosity in the range of 7 to 40 cSt at 100° C. In addition, the '571 application discloses that the combination of a Group II base oil and a low polycyclic aromatic brightstock extract demonstrated improved viscosity ratio and improved oxidation and wear performance.

Applicants have found that wear performance of a marine cylinder lubricant used in a cylinder of a 2-stroke crosshead marine diesel engine can be maintained by formulating a marine cylinder lubricant containing a major amount of a basestock selected from the group consisting of a Group II basestock, a Group III basestock and mixtures thereof, wherein the marine cylinder lubricant has a kinematic viscosity at 100° C. of from 13 to about 16.2 cSt; and contains less than about 10 wt. % bright stock.

SUMMARY OF THE INVENTION

In accordance with one embodiment of the present invention, a marine cylinder lubricant is provided which comprises a major amount of a basestock selected from the group consisting of a Group II basestock, a Group III basestock and mixtures thereof, wherein the marine cylinder lubricant has a kinematic viscosity at 100° C. of from 13 to about 16.2 cSt; and contains less than about 10 wt. % bright stock.

In accordance with a second embodiment of the present invention, there is provided a method for maintaining wear performance of a marine cylinder lubricant used in a cylinder of a 2-stroke crosshead marine diesel engine comprising a major amount of basestock selected from the group consisting of a Group II basestock, a Group III basestock and mixtures thereof, wherein the marine cylinder lubricant has a kinematic viscosity at 100° C. of from 13 to about 16.2 cSt; and contains less than about 10 wt. % bright stock.

In accordance with a third embodiment of the present invention, the use of a marine cylinder lubricant comprising a major amount of basestock selected from the group consisting of a Group II basestock, a Group III basestock and mixtures thereof, wherein the marine cylinder lubricant has a kinematic viscosity at 100° C. of from 13 to about 16.2 cSt; and contains less than about 10 wt. % bright stock; for the purpose of maintaining wear performance of a marine cylinder lubricant used in a cylinder of a 2-stroke crosshead marine diesel engine is provided.

In accordance with a fourth embodiment of the present invention, a marine cylinder lubricant is provided which comprises a major amount of a bakstock selected from the group consisting of a Group II basestock, a Group III basestock and mixtures thereof, wherein the marine cylinder lubricant has a kinematic viscosity at 100° C. of between about 13 and about 16.2 cSt; and a total base number of 5 to about 70, and further wherein the marine cylinder lubricant contains less than about 10 wt. % bright stock.

In accordance with a fifth embodiment of the present invention, there is provided a method for maintaining wear performance of a marine cylinder lubricant used in a cylinder of a 2-stroke crosshead marine diesel engine comprising lubricating the cylinder with a marine cylinder lubricant comprising a major amount of basestock selected from the group consisting of a Group II basestock, a Group III basestock and mixtures thereof, wherein the marine cylinder lubricant has a kinematic viscosity at 100° C. of between about 13 and about 16.2 cSt; and a total base number of 5 to about 70, and further wherein the marine cylinder lubricant contains less than about 10 wt. % bright stock.

In accordance with a sixth embodiment of the present invention, the use of a marine cylinder lubricant comprising a major amount of basestock selected from the group consisting of a Group II basestock, a Group III basestock and mixtures thereof, wherein the marine cylinder lubricant has a kinematic viscosity at 100° C. of between about 13 and about 16.2 cSt; and a total base number of 5 to about 70, and further wherein the marine cylinder lubricant contains less than about 10 wt. % bright stock, for the purpose of maintaining wear performance of a marine cylinder lubricant used in a cylinder of a 2-stroke crosshead marine diesel engine is provided.

DETAILED DESCRIPTION OF THE PREFERRED EMBODIMENTS

Definitions

The term "TBN" means the Total Base Number of a lubricant as measured by the ASTM D-2896 test.

The term "marine cylinder lubricant" as used herein shall be understood to mean a lubricant used in the cylinder lubrication of a slow speed or medium speed diesel engine. The marine cylinder lubricant is fed to the cylinder walls through a number of injection points. The marine cylinder lubricants of the present invention are capable of providing a film between the cylinder liner and the piston rings and holding partially burned fuel residues in suspension, to thereby promote engine cleanliness and neutralize acids formed by, for example, the combustion of sulfur compounds in the fuel.

The term "bright stock", as used by persons skilled in the art, refers to base oils that are direct products of de-asphalted petroleum vacuum residuum or derived from de-asphalted petroleum vacuum residuum after further processing such as solvent extraction and/or dewaxing. For the purposes of this invention, it also refers to deasphalted distillate cuts of a vacuum residuum process. Bright stocks generally have a kinematic viscosity at 100° C. of from 28 to 36 $mm^2/s$. One example of such a bright stock is ESSO™ Core 2500 Base Oil.

A "low sulfur residual fuel" refers to a fuel having about 1.5 wt. % or less of sulfur, such as fuels having about 1.4 wt. % or less, about 1.3 wt. % or less, about 1.2 wt. % or less, about 1.0 wt. % or less, about 0.8 wt. % or less, about 0.6 wt. % or less, or even about 0.4 wt. % or less of sulfur, relative to the total weight of the fuel, wherein the fuel is the residual product of a distillation process.

A "low sulfur distillate fuel" refers to a fuel having about 1.5 wt. % or less of sulfur, such as fuels having about 0.1 wt. % or less, about 0.3 wt. % or less, about 0.01 wt. % or less, about 0.002 wt. % or less, or even about 0.001 wt. % or less of sulfur, relative to the total weight of the fuel wherein the fuel is a distillation cut of a distillation process.

A "marine residual fuel" refers to a material combustible in large marine engines which has a carbon residue, as defined in International Organization for Standardization (ISO) 10370) of greater than 2.50 wt. % (relative to the total weight of the fuel), a viscosity at 50° C. of greater than 14.0 cSt, and a micro carbon residue of at least 2.5 wt. % (e.g., at least 5 wt. %, or at least 8 wt. %) (relative to the total weight of the fuel), such as the marine residual fuels defined in the International Organization for Standardization specification ISO 8217:2005, "Petroleum products—Fuels (class F)—Specifications of marine fuels," the contents of which are incorporated herein in their entirety.

In one embodiment, the marine cylinder lubricants of the invention are employed in a slow-speed crosshead diesel engine fueled by a low sulfur residual fuel. In another embodiment, the marine cylinder lubricants of the invention are employed in a slow-speed crosshead diesel engine fueled by a low sulfur distillate fuel.

In one embodiment, a marine cylinder lubricant is provided which comprises a major amount of basestock selected from the group consisting of a Group II basestock, a Group III basestock and mixtures thereof, wherein the marine cylinder lubricant has a kinematic viscosity at 100° C. of between about 13 and about 16.2 cSt; and contains less than about 10 wt. % bright stock.

The basestock selected from the group consisting of a Group II basestock, a Group III basestock and mixtures thereof is typically present in a major amount, e.g., an amount of greater than 50 wt. %, preferably greater than about 70 wt. %, more preferably from about 80 to about 99.5 wt. % and most preferably from about 85 to about 98 wt. %, based on the total weight of the composition.

In general, a Group II base oil and/or Group III base oil can be any petroleum derived base oil of lubricating viscosity as defined in API Publication 1509, 14th Edition, Addendum I, December 1998. API guidelines define a base stock as a lubricant component that may be manufactured using a variety of different processes. Group II base oils generally refer to a petroleum derived lubricating base oil having a total sulfur content equal to or less than 300 parts per million (ppm) (as determined by ASTM D 2622, ASTM D 4294, ASTM D 4927 or ASTM D 3120), a saturates content equal to or greater than 90 weight percent (as determined by ASTM D 2007), and a viscosity index (VI) of between 80 and 120 (as determined by ASTM D 2270).

Group III base oils generally have less than 300 ppm sulfur, a saturates content greater than 90 weight percent, and a VI of 120 or greater. In one embodiment, the Group III base stock contains at least about 95% by weight saturated hydrocarbons. In another embodiment, the Group III base stock contains at least about 99% by weight saturated hydrocarbons.

In one preferred embodiment, the basestock is one or more Group II base oils.

The marine cylinder lubricant of the first embodiment can have any total base number (TBN) that is suitable for use in marine engines. The term "total base number" or "TBN" refers to the amount of base equivalent to milligrams of KOH in 1 gram of sample. Thus, higher TBN numbers reflect more alkaline products and therefore a greater alkalinity reserve. The TBN of the marine cylinder lubricant can be measured by any suitable method, such as by ASTM D2896. In one embodiment, the marine cylinder lubricant can have a TBN of at least about 5. In one embodiment, the marine cylinder lubricant can have a TBN of at least about 10. In one embodiment, the marine cylinder lubricant can have a TBN of at least about 20. In one embodiment, the marine cylinder lubricant can have a TBN of at least about 30. In one embodiment, the marine cylinder lubricant can have a TBN of from about 5 to about 70. In one embodiment, the marine cylinder lubricant can have a TBN of from about 10 to about 70. In one embodiment, the marine cylinder lubricant can have a TBN of from about 35 to about 70. In one embodiment, the marine cylinder lubricant can have a TBN of from about 40 to about 70. In one embodiment, the marine cylinder lubricant can have a TBN of from about 35 to about 60. In one embodiment, the marine cylinder lubricant can have a TBN of from about 40 to about 55.

The marine cylinder lubricant of the first embodiment can have a kinematic viscosity ranging from 13 to about 16.2 centistokes (cSt) at 100° C. In one embodiment, the marine cylinder lubricant of the first embodiment can have a kinematic viscosity ranging from about 13.25 to about 16.2 cSt at 100° C. In one embodiment, the marine cylinder lubricant of the first embodiment can have a kinematic viscosity ranging from about 13.50 to about 16.2 cSt at 100° C. The viscosity of the marine cylinder lubricant can be measured by any suitable method, e.g., ASTM D445.

The marine cylinder lubricants of the present invention contain less than about 10 wt. % of a bright stock. In one embodiment, the marine cylinder lubricants of the present invention contain less than about 5 wt. % of a bright stock. In one embodiment, the marine cylinder lubricants of the present invention are substantially free of a bright stock. The term "substantially free" as used herein shall be understood to mean relatively little to no amount of any bright stock, e.g., an amount less than 0.2 wt. %, more preferably less than 0.1 wt. %, and most preferably 0 wt. %, based on the total weight of the marine cylinder lubricant.

In one embodiment, the marine cylinder lubricants of the present invention contains less than about 10 wt. % of a Fischer-Tropsch derived base oil. In one embodiment, the marine cylinder lubricants of the present invention contains less than about 5 wt. % of a Fischer-Tropsch derived base oil. In one embodiment, the marine cylinder lubricants of the present invention are substantially free of a Fischer-Tropsch derived base oil. The term "substantially free" as used herein shall be understood to mean relatively little to no amount of any Fischer-Tropsch derived base oil, e.g., an amount less than 0.2 wt. %, more preferably less than 0.1 wt. %, and most preferably 0 wt. %, based on the total weight of the marine cylinder lubricant. The term "Fischer-Tropsch derived" means that the product, fraction, or feed originates from or is produced at some stage by a Fischer-Tropsch process. For example, a Fischer Tropsch base oil can be produced from a process in which the feed is a waxy feed recovered from a Fischer-Tropsch synthesis, see, e.g., U.S. Patent Application Publication Nos. 2004/0159582; 2005/0077208; 2005/0133407; 2005/0133409; 2005/0139513; 2005/0139514; 2005/0241990; 2005/0261145; 2005/0261146; 2005/0261147; 2006/0016721; 2006/0016724; 2006/0076267; 2006/013210; 2006/0201851; 2006/020185, and 2006/0289337; U.S. Pat. Nos. 7,018,525 and 7,083,713 and U.S. application Ser. Nos. 11/400,570, 11/535,165 and 11/613,936, each of which are incorporated herein by reference. In general, the process involves a complete or partial hydroisomerization dewaxing step, employing a dual-functional catalyst or a catalyst that can isomerize paraffins selectively. Hydroisomerization dewaxing is achieved by contacting the waxy feed with a hydroisomerization catalyst in an isomerization zone under hydroisomerizing conditions.

Fischer-Tropsch synthesis products can be obtained by well-known processes such as, for example, the commercial SASOL® Slurry Phase Fischer-Tropsch technology, the commercial SHELL® Middle Distillate Synthesis (SMDS) Process, or by the non-commercial EXXON® Advanced Gas Conversion (AGC-21) process. Details of these processes and others are described in, for example, WO-A-9934917; WO-A-9920720; WO-A-05107935; EP-A-776959; EP-A-668342; U.S. Pat. Nos. 4,943,672, 5,059,299, 5,733,839, and RE39073; and U.S. Patent Application Publication No. 2005/0227866. The Fischer-Tropsch synthesis product can contain hydrocarbons having 1 to about 100 carbon atoms or, in some cases, more than 100 carbon atoms, and typically includes paraffins, olefins and oxygenated products.

In one embodiment, the marine cylinder lubricants of the present invention are substantially free of a Group I base oil. The term "substantially free" as used herein shall be understood to mean relatively little to no amount of any Group 1 base oil, e.g., an amount less than about 5 wt. %, preferably less than 1 wt. %, and most preferably less than 0.1 wt. %, based on the total weight of the marine cylinder lubricant. The term "Group I base oil" as used herein refers to a petroleum derived lubricating base oil having a saturates content of less than 90 wt. % (as determined by ASTM D 2007) and/or a total sulfur content of greater than 300 ppm (as determined by ASTM D 2622, ASTM D 4294, ASTM D 4297 or ASTM D 3120) and has a viscosity index (VI) of greater than or equal to 80 and less than 120 (as determined by ASTM D 2270).

The marine cylinder lubricants of the present invention can be prepared by any method known to a person of ordinary skill in the art for making marine cylinder lubricants. The ingredients can be added in any order and in any manner. Any suitable mixing or dispersing equipment may be used for blending, mixing or solubilizing the ingredients. The blending, mixing or solubilizing may be carried out with a blender, an agitator, a disperser, a mixer (e.g., planetary mixers and double planetary mixers), a homogenizer (e.g., a Gaulin homogenizer or Ranine homogenizer), a mill (e.g., colloid mill, ball mill or sand mill) or any other mixing or dispersing equipment known in the art.

The marine cylinder lubricants of the present invention may also contain conventional marine cylinder engine lubricating oil composition additives for imparting auxiliary functions to give a marine cylinder lubricating oil composition in which these additives are dispersed or dissolved. For example, the marine cylinder lubricants can be blended with antioxidants, ashless dispersants, detergents such as metal detergents, anti-wear agents, rust inhibitors, dehazing agents, demulsifying agents, metal deactivating agents, friction modifiers, pour point depressants, antifoaming agents, co-solvents, package compatibilisers, corrosion-inhibitors, dyes, extreme pressure agents and the like and mixtures thereof. A variety of the additives are known and commercially available. These additives, or their analogous compounds, can be employed for the preparation of the marine cylinder lubricants of the invention by the usual blending procedures.

In one embodiment, the marine cylinder lubricants of the present invention contain essentially no thickener.

Examples of antioxidants include, but are not limited to, aminic types, e.g., diphenyla mine, phenyl-alpha-napthylamine, N,N-di(alkylphenyl) amines; and alkylated phenylene-diamines; phenolics such as, for example, BHT, sterically hindered alkyl phenols such as 2,6-di-tert-butylphenol, 2,6-di-tert-butyl-p-cresol and 2,6-di-tert-butyl-4-(2-octyl-3-propanoic) phenol; and mixtures thereof.

The ashless dispersant compounds employed in the marine cylinder lubricants of the present invention are generally used to maintain in suspension insoluble materials resulting from oxidation during use, thus preventing sludge flocculation and precipitation or deposition on metal parts. Dispersants may also function to reduce changes in lubricating oil viscosity by preventing the growth of large contaminant particles in the lubricant. The dispersant employed in the present invention may be any suitable ashless dispersant or mixture of multiple ashless dispersants for use in a marine cylinder lubricant. An ashless dispersant generally comprises an oil soluble polymeric hydrocarbon backbone having functional groups that are capable of associating with particles to be dispersed.

In one embodiment, an ashless dispersant is one or more basic nitrogen-containing ashless dispersants. Nitrogen-containing basic ashless (metal-free) dispersants contribute to the base number or BN (as can be measured by ASTM D 2896) of a lubricating oil composition to which they are added, without introducing additional sulfated ash. Basic nitrogen-containing ashless dispersants useful in this invention include hydrocarbyl succinimides; hydrocarbyl succinamides; mixed ester/amides of hydrocarbyl-substituted succinic acids formed by reacting a hydrocarbyl-substituted succinic acylating agent stepwise or with a mixture of alcohols and amines, and/or with amino alcohols; Mannich condensation products of hydrocarbyl-substituted phenols, formaldehyde and polyamines; and amine dispersants formed by reacting high molecular weight aliphatic or alicyclic halides with amines, such as polyalkylene polyamines. Mixtures of such dispersants can also be used.

Representative examples of ashless dispersants include, but are not limited to, amines, alcohols, amides, or ester polar moieties attached to the polymer backbones via bridging groups. An ashless dispersant of the present invention may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons, long chain aliphatic hydrocarbons having a polyamine attached directly thereto; and Mannich condensation products formed by condensing a long chain substituted phenol with formaldehyde and polyalkylene polyamine.

Carboxylic dispersants are reaction products of carboxylic acylating agents (acids, anhydrides, esters, etc.) comprising at least about 34 and preferably at least about 54 carbon atoms with nitrogen containing compounds (such as amines), organic hydroxy compounds (such as aliphatic compounds including monohydric and polyhydric alcohols, or aromatic compounds including phenols and naphthols), and/or basic inorganic materials. These reaction products include imides, amides, and esters.

Succinimide dispersants are a type of carboxylic dispersant. They are produced by reacting hydrocarbyl-substituted succinic acylating agent with organic hydroxy compounds, or with amines comprising at least one hydrogen atom attached to a nitrogen atom, or with a mixture of the hydroxy compounds and amines. The term "succinic acylating agent" refers to a hydrocarbon-substituted succinic acid or a succinic acid-producing compound, the latter encompasses the acid itself. Such materials typically include hydrocarbyl-substituted succinic acids, anhydrides, esters (including half esters) and halides.

Succinic-based dispersants have a wide variety of chemical structures. One class of succinic-based dispersants may be represented by the formula:

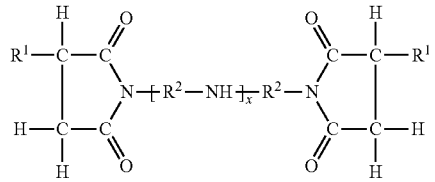

wherein each $R^1$ is independently a hydrocarbyl group, such as a polyolefin-derived group. Typically the hydrocarbyl group is an alkyl group, such as a polyisobutyl group. Alternatively expressed, the $R^1$ groups can contain about 40 to about 500 carbon atoms, and these atoms may be present in aliphatic forms. $R^2$ is an alkylene group, commonly an ethylene ($C_2H_4$) group. Examples of succinimide dispersants include those described in, for example, U.S. Pat. Nos. 3,172,892, 4,234,435 and 6,165,235.

The polyalkenes from which the substituent groups are derived are typically homopolymers and interpolymers of polymerizable olefin monomers of 2 to about 16 carbon atoms, and usually 2 to 6 carbon atoms. The amines which are reacted with the succinic acylating agents to form the carboxylic dispersant composition can be monoamines or polyamines.

Succinimide dispersants are referred to as such since they normally contain nitrogen largely in the form of imide functionality, although the amide functionality may be in the form of amine salts, amides, imidazolines as well as mixtures thereof. To prepare a succinimide dispersant, one or more succinic acid-producing compounds and one or more amines are heated and typically water is removed, optionally in the presence of a substantially inert organic liquid solvent/diluent. The reaction temperature can range from about 80° C. up to the decomposition temperature of the mixture or the product, which typically falls between about 100° C. to about 300° C. Additional details and examples of procedures for preparing the succinimide dispersants of the present invention include those described in, for example, U.S. Pat. Nos. 3,172,892, 3,219,666, 3,272,746, 4,234,435, 6,165,235 and 6,440,905.

Suitable ashless dispersants may also include amine dispersants, which are reaction products of relatively high molecular weight aliphatic halides and amines, preferably polyalkylene polyamines. Examples of such amine dispersants include those described in, for example, U.S. Pat. Nos. 3,275,554, 3,438,757, 3,454,555 and 3,565,804.

Suitable ashless dispersants may further include "Mannich dispersants," which are reaction products of alkyl phenols in which the alkyl group contains at least about 30 carbon atoms with aldehydes (especially formaldehyde) and amines (especially polyalkylene polyamines). Examples of such dispersants include those described in, for example, U.S. Pat. Nos. 3,036,003, 3,586,629, 3,591,598 and 3,980,569.

Suitable ashless dispersants may also be post-treated ashless dispersants such as post-treated succinimides, e.g., post-treatment processes involving borate or ethylene carbonate as disclosed in, for example, U.S. Pat. Nos. 4,612,132 and 4,746,446; and the like as well as other post-treatment processes. The carbonate-treated alkenyl succinimide is a polybutene succinimide derived from polybutenes having a molecular weight of about 450 to about 3000, preferably from about 900 to about 2500, more preferably from about 1300 to about 2400, and most preferably from about 2000 to about 2400, as well as mixtures of these molecular weights. Preferably, it is prepared by reacting, under reactive conditions, a mixture of a polybutene succinic acid derivative, an unsaturated acidic reagent copolymer of an unsaturated acidic reagent and an olefin, and a polyamine, such as disclosed in U.S. Pat. No. 5,716,912, the contents of which are incorporated herein by reference.

Suitable ashless dispersants may also be polymeric, which are interpolymers of oil-solubilizing monomers such as decyl methacrylate, vinyl decyl ether and high molecular weight olefins with monomers containing polar substitutes. Examples of polymeric dispersants include those described in, for example, U.S. Pat. Nos. 3,329,658; 3,449,250 and 3,666,730.

In one preferred embodiment of the present invention, an ashless dispersant for use in the lubricating oil composition is a bis-succinimide derived from a polyisobutenyl group having a number average molecular weight of about 700 to about 2300. The dispersant(s) for use in the lubricating oil compositions of the present invention are preferably non-polymeric (e g., are mono- or bis-succinimides).

Representative examples of metal detergents include sulphonates, alkylphenates, sulfurized alkyl phenates, carboxylates, salicylates, phosphonates, and phosphinates. Commercial products are generally referred to as neutral or overbased. Overbased metal detergents are generally produced by carbonating a mixture of hydrocarbons, detergent acid, for example: sulfonic acid, alkylphenol, carboxylate etc., metal oxide or hydroxides (for example calcium oxide or calcium hydroxide) and promoters such as xylene, methanol and water. For example, for preparing an overbased calcium sulfonate, in carbonation, the calcium oxide or hydroxide reacts with the gaseous carbon dioxide to form calcium carbonate. The sulfonic acid is neutralized with an excess of CaO or $Ca(OH)_2$, to form the sulfonate.

Metal-containing or ash-forming detergents function as both detergents to reduce or remove deposits and as acid neutralizers or rust inhibitors, thereby reducing wear and corrosion and extending engine life. Detergents generally comprise a polar head with a long hydrophobic tail. The polar head comprises a metal salt of an acidic organic compound. The salts may contain a substantially stoichiometric amount of the metal in which case they are usually described as normal or neutral salts, and would typically have a total base number or TBN (as can be measured by ASTM D2896) of from 0 to about 80. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g., carbonate) micelle. Such overbased detergents may have a TBN of about 150 or greater, and typically will have a TBN of from about 250 to about 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from about 20 to about 450, neutral and overbased calcium phenates and sulfurized phenates having TBN of from about 50 to about 450 and neutral and overbased magnesium or calcium salicylates having a TBN of from about 20 to about 450. Combinations of detergents, whether overbased or neutral or both; may be used.

In one embodiment, the detergent can be one or more alkali or alkaline earth metal salts of an alkyl-substituted hydroxyaromatic carboxylic acid. Suitable hydroxyaromatic compounds include mononuclear monohydroxy and polyhydroxy aromatic hydrocarbons having 1 to 4, and preferably 1 to 3, hydroxyl groups. Suitable hydroxyaromatic compounds include phenol, catechol, resorcinol, hydroquinone, pyrogallol, cresol, and the like. The preferred hydroxyaromatic compound is phenol.

The alkyl substituted moiety of the alkali or alkaline earth metal salt of an alkyl-substituted hydroxyaromatic carboxylic acid is derived from an alpha olefin having from about 10 to about 80 carbon atoms. The olefins employed may be linear, isomerized linear, branched or partially branched linear. The olefin may be a mixture of linear olefins, a mixture of isomerized linear olefins, a mixture of branched olefins, a mixture of partially branched linear or a mixture of any of the foregoing.

In one embodiment, the mixture of linear olefins that may be used is a mixture of normal alpha olefins selected from olefins having from about 12 to about 30 carbon atoms per molecule. In one embodiment, the normal alpha olefins are isomerized using at least one of a solid or liquid catalyst.

In another embodiment, the olefins are a branched olefinic propylene oligomer or mixture thereof having from about 20 to about 80 carbon atoms, i.e., branched chain olefins derived from the polymerization of propylene. The olefins may also be substituted with other functional groups, such as hydroxy groups, carboxylic acid groups, heteroatoms, and the like. In one embodiment, the branched olefinic propylene oligomer or mixtures thereof have from about 20 to about 60 carbon atoms. In one embodiment, the branched olefinic propylene oligomer or mixtures thereof have from about 20 to about 40 carbon atoms.

In one embodiment, at least about 75 mole % (e.g., at least about 80 mole %, at least about 85 mole %, at least about 90 mole %, at least about 95 mole %, or at least about 99 mole %) of the alkyl groups contained within the alkali or alkaline earth metal salt of an alkyl-substituted hydroxyaromatic carboxylic acid such as the alkyl groups of an alkaline earth metal salt of an alkyl-substituted hydroxybenzoic acid detergent are a $C_{20}$ or higher. In another embodiment, the alkali or alkaline earth metal salt of an alkyl-substituted hydroxyaromatic carboxylic acid is an alkali or alkaline earth metal salt of an alkyl-substituted hydroxybenzoic acid that is derived from an alkyl-substituted hydroxybenzoic acid in which the alkyl groups are the residue of normal alpha-olefins containing at least 75 mole % $C_{20}$ or higher normal alpha-olefins.

In another embodiment, at least about 50 mole % (e.g., at least about 60 mole %, at least about 70 mole %, at least about 80 mole %, at least about 85 mole %, at least about 90 mole %, at least about 95 mole %, or at least about 99 mole %) of the alkyl groups contained within the alkali or alkaline earth metal salt of an alkyl-substituted hydroxyaromatic carboxylic acid such as the alkyl groups of an alkali or alkaline earth metal salt of an alkyl-substituted hydroxybenzoic acid are about $C_{14}$ to about $C_{18}$.

The resulting alkali or alkaline earth metal salt of an alkyl-substituted hydroxyaromatic carboxylic acid will be a mixture of ortho and para isomers. In one embodiment, the product will contain about 1 to 99% ortho isomer and 99 to 1% para isomer. In another embodiment, the product will contain about 5 to 70% ortho and 95 to 30% para isomer.

The alkali or alkaline earth metal salts of an alkyl-substituted hydroxyaromatic carboxylic acid can be neutral or overbased. Generally, an overbased alkali or alkaline earth metal salt of an alkyl-substituted hydroxyaromatic carboxylic acid is one in which the BN of the alkali or alkaline earth metal salts of an alkyl-substituted hydroxyaromatic carboxylic acid has been increased by a process such as the addition of a base source (e.g., lime) and an acidic overbasing compound (e.g., carbon dioxide).

Overbased salts may be low overbased, e.g., an overbased salt having a BN below about 100. In one embodiment, the BN of a low overbased salt may be from about 5 to about 50. In another embodiment, the BN of a low overbased salt may be from about 10 to about 30. In yet another embodiment, the BN of a low overbased salt may be from about 15 to about 20.

Overbased detergents may be medium overbased, e.g., an overbased salt having a BN from about 100 to about 250. In one embodiment, the BN of a medium overbased salt may be from about 100 to about 200. In another embodiment, the BN of a medium overbased salt may be from about 125 to about 175.

Overbased detergents may be high overbased, e.g., an overbased salt having a BN above about 250. In one embodiment, the BN of a high overbased salt may be from about 250 to about 450.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to about 220 wt. % (preferably at least about 125 wt. %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Examples of rust inhibitors include, but are not limited to, nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof; synthetic alkarylsulfonates, e.g., metal dinonylnaphthalene sulfonates; and the like and mixtures thereof.

Examples of friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are incorporated by reference herein; friction modifiers obtained from a reaction product of a $C_4$ to $C_{75}$, preferably a $C_6$ to $C_{24}$, and most preferably a $C_6$ to $C_{20}$ fatty acid ester and a nitrogen-containing compound selected from the group consisting of ammonia, and an alkanolamine and the like and mixtures thereof.

Examples of antiwear agents include, but are not limited to, zinc dialkyldithiophosphates and zinc diaryldithiophosphates, e.g., those described in an article by Born et al. entitled "Relationship between Chemical Structure and Effectiveness of Some Metallic Dialkyl- and Diaryl-dithiophosphates in Different Lubricated Mechanisms", appearing in Lubrication Science 4-2 Jan. 1992, see for example pages 97-100; aryl phosphates and phosphites, sulfur-containing esters, phosphosulfur compounds, metal or ash-free dithiocarbamates, xanthates, alkyl sulfides and the like and mixtures thereof.

Examples of antifoaming agents include, but are not limited to, polymers of alkyl methacrylate; polymers of dimethylsilicone and the like and mixtures thereof.

Examples of a pour point depressant include, but are not limited to, polymethacrylates, alkyl acrylate polymers, alkyl methacrylate polymers, di(tetra-paraffin phenol)phthalate, condensates of tetra-paraffin phenol, condensates of a chlorinated paraffin with naphthalene and combinations thereof. In one embodiment, a pour point depressant comprises an ethylene-vinyl acetate copolymer, a condensate of chlorinated paraffin and phenol, polyalkyl styrene and the like and combinations thereof. The amount of the pour point depressant may vary from about 0.01 wt. % to about 10 wt. %.

Examples of a demulsifier include, but are not limited to, anionic surfactants (e.g., alkyl-naphthalene sulfonates, alkyl benzene sulfonates and the like), nonionic alkoxylated alkylphenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and the like and combinations thereof. The amount of the demulsifier may vary from about 0.01 wt. % to about 10 wt. %.

Examples of a corrosion inhibitor include, but are not limited to, half esters or amides of dodecylsuccinic acid, phosphate esters, thiophosphates, alkyl imidazolines, sarcosines and the like and combinations thereof. The amount of the corrosion inhibitor may vary from about 0.01 wt. % to about 0.5 wt. %.

Examples of an extreme pressure agent include, but are not limited to, sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and the like and combinations thereof. The amount of the extreme pressure agent may vary from about 0.01 wt. % to about 5 wt. %.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant. Generally, the concentration of each of these additives, when used, ranges from about 0.001% to about 20% by weight, and in one embodiment about 0.01% to about 10% by weight based on the total weight of the lubricating oil composition.

If desired, the marine cylinder lubricant additives may be provided as an additive package or concentrate in which the additives are incorporated into a substantially inert, normally liquid organic diluent such as, for example, mineral oil, naphtha, benzene, toluene or xylene to form an additive concentrate. These concentrates usually contain from about 20% to about 80% by weight of such diluent. Typically a neutral oil having a viscosity of about 4 to about 8.5 cSt at 100° C. and preferably about 4 to about 6 cSt at 100° C. will be used as the diluent, though synthetic oils, as well as other organic liquids which are compatible with the additives and finished lubricating oil can also be used. The additive package will typically contain one or more of the various additives, referred to above, in the desired amounts and ratios to facilitate direct combination with the requisite amount of the base stock containing at least 90% by weight saturated hydrocarbons and base oil having a viscosity index of less than 70 and at least about 25 wt. % cycloaliphatic hydrocarbon content.

The following non-limiting examples are illustrative of the present invention.

The tendency of marine cylinder lubricants to decrease in Total Base Number during use can be evaluated using the Modified Institute of Petroleum 48 (MIP-48) Test MIP-48 and Indiana Stirring Oxidation Test (ISOT).

Modified Institute of Petroleum 48 (MIP-48) Test

Two samples of the test lubricant are heated for a specified period of time. Nitrogen is passed through one of the test samples while air is passed through the other. The samples are cooled and the TBN of both samples is determined. The MIP-48 TBN Depletion is calculated by subtracting the TBN for the nitrogen blown sample from the TBN for the air blown sample, dividing the subtraction product by the TBN for the nitrogen blown sample, and multiplying the result by 100 to obtain the % MIP-48 TBN Depletion.

Indiana Stirring Oxidation Test (ISOT)

Two catalyst plates (copper and steel) and a glass varnish rod are immersed in test oil, and the test oil is heated and aerated by stirring for the duration of the test. At the end of the heating period the TBN of the test lubricant is measured. The ISOT TBN Depletion is calculated by subtracting the TBN for the heated sample from the TBN for the fresh lubricant, dividing the subtraction product by the TBN for the fresh lubricant, and multiplying the result by 100 to obtain the % ISOT TBN Depletion.

A base-line marine cylinder lubricant additive package was prepared which contained 33.40 wt. % of a 425 TBN calcium sulfonate concentrate, 57.37 wt. % of a 260 TBN sulfurized calcium phenate concentrate, 4.10 wt. % of succinimide dispersant concentrate, and remainder diluent oil. The package contained 11.2 wt. % calcium.

A series of 18 cylinder lubricants were prepared by blending the above package with certain basestocks as shown in Examples 1-18 in Tables I, II, and III. Examples 1-6 in Table I all contained 23.24 wt. % of the additive package to deliver 70 TBN lubricants. Examples 7-12 in Table II all contained 13.28 wt. % of the additive package to deliver 40 TBN lubricants. Examples 13-18 in Table III all contained 3.32 wt. % of the additive package to deliver 10 TBN lubricants.

A number of different basestocks were evaluated in this study. Group I base oils included were ExxonMobil CORE® 150 and CORE® 600. Group I bright stock was ExxonMobil CORE® 2500. Group I Base Oil #3 was ExxonMobil CORE® 150. The Group II base oils were Chevron 600R Group II base stock and 110RLV base stock, available from Chevron Products Company (San Ramon, Calif.).

TABLE I

70 TBN Marine Cylinder Lubricants

| | Ex. 1 | Ex. 2 | Ex. 3 | Ex. 4 | Ex. 5 | Ex. 6 |
|---|---|---|---|---|---|---|
| Esso 150N (Group I), wt. % | — | — | 38.4 | — | — | — |
| Esso 600N (Group I), wt. % | 59.2 | 76.8 | — | — | — | |
| Chevron 110RLV (Group II), wt. % | — | — | — | — | — | 34.8 |
| Chevron 600R (Group II), wt. % | — | — | — | 56.8 | 76.8 | — |
| Esso Core 2500 (brightstock), wt. % | 17.6 | — | 38.4 | 20.0 | — | 42 |
| Viscosity @ 100° C., cSt | 19.2 | 15.9 | 15.9 | 19.3 | 15.6 | 15.5 |
| Fresh oil TBN[1] | 67.5 | 66.3 | 66.7 | 69.0 | 66.8 | 69.5 |
| MIP-48 TBN After N | 71.0 | 71.6 | 75.2 | 71.7 | 68.7 | 74.3 |
| MIP-48 TBN After Air | 55.1 | 57.6 | 61.2 | 61.4 | 59.5 | 61.4 |
| MIP-48 TBN Depletion, % | 22 | 20 | 19 | 14 | 13 | 17 |
| ISOT TBN, End of Test | | 62.5 | 63.0 | | 64.0 | 63.4 |
| ISOT TBN depletion, % | | 5.7 | 5.5 | | 4.2 | 8.8 |

[1]All TBN units are mg KOH/g sample

TABLE II

| 40 TBN Marine Cylinder Lubricants | Ex. 7 | Ex. 8 | Ex. 9 | Ex. 10 | Ex. 11 | Ex. 12 |
|---|---|---|---|---|---|---|
| Esso 150N (Group I), wt. % | — | — | 43.7 | — | — | — |
| Esso 600N (Group I), wt. % | 53.7 | 86.7 | — | — | — | — |
| Chevron 110RLV (Group II), wt. % | — | — | — | — | — | 39.2 |
| Chevron 600R (Group II), wt. % | — | — | — | 52.2 | 86.7 | — |
| Esso Core 2500 (brightstock), wt. % | 33.0 | — | 43.0 | 34.5 | — | 47.5 |
| Viscosity @ 100° C., cSt | 19.4 | 14.0 | 13.8 | 19.2 | 13.8 | 13.5 |
| Fresh oil TBN[1] | 38.4 | 38.1 | 40.1 | 40.1 | 37.7 | 38.7 |
| MIP-48 TBN After N | 39.5 | 40.7 | 42.4 | 39.9 | 39.8 | 42.3 |
| MIP-48TBN After Air | 29.2 | 28.4 | 32.1 | 32.1 | 32.5 | 33.6 |
| MIP-48 TBN Depletion, % | 26 | 30 | 24 | 20 | 18 | 21 |
| ISOT TBN, End of Test | | 35.2 | 34.1 | | 36.5 | 36.0 |
| ISOT TBN depletion, % | | 7.6 | 15.0 | | 3.2 | 7.0 |

[1]All TBN units are mg KOH/g sample

TABLE III

| 10 TBN Marine Cylinder Lubricants | Ex. 13 | Ex. 14 | Ex. 15 | Ex. 16 | Ex. 17 | Ex. 18 |
|---|---|---|---|---|---|---|
| Esso 150N (Group I), wt. % | — | — | 46.7 | — | — | — |
| Esso 600N (Group I), wt. % | 49.2 | 96.7 | — | — | — | — |
| Chevron 110RLV (Group II), wt. % | — | — | — | — | — | 41.7 |
| Chevron 600R (Group II), wt. % | — | — | — | 48.2 | 96.7 | — |
| Esso Core 2500 (brightstock), wt. % | 47.5 | — | 50.0 | 48.5 | — | 55.0 |
| Viscosity @ 100° C., cSt | 19.5 | 12.5 | 12.7 | 19.3 | 12.4 | 12.6 |
| Fresh oil TBN[1] | 10.1 | 9.8 | 9.8 | 10.4 | 9.5 | 9.8 |
| MIP-48 TBN After N | 10.2 | 10.4 | 10.9 | 10.0 | 9.6 | 10.7 |
| MIP-48 TBN After Air | 4.1 | 2.8 | 5.0 | 6.1 | 8.2 | 6.4 |
| MIP-48 TBN Depletion, % | 60 | 73 | 54 | 39 | 15 | 41 |
| ISOT TBN, End of Test | | 4.9 | 6.2 | | 5.2 | 24.6 |
| ISOT TBN depletion; % | | 49.7 | 36.3 | | 3.2 | 7.0 |

[1]All TBN units are mg KOH/g sample

As the data show, when comparing the cylinder lubricants of equal TBN, it is seen that the marine cylinder lubricants containing a major amount of Group II base oils with little or no added briahtstock (i.e., Examples 5, 11, and 17) show the smallest TBN depletion as measured by either MIP-48 or ISOT BN Depletion.

The marine cylinder lubricants of the present invention were also evaluated for wear in a Marine High Frequency Reciprocating Rig (HFRR) Wear Test.

Marine High Frequency Reciprocating Rig (HFRR) Wear Test

The Marine HFRR wear test is an adaptation of a test commonly used to evaluate the wear performance of fuels and lubricants, as for example in ASTM test D6079-04. The test is run by loading small sample of marine lubricant in a test reservoir of a PCS HFRR rig equipped with software to control the experiment and acquire data, and equipped with the High Temperature option. Both the equipment and software are obtainable from PCS Instruments. The lubricant in the test reservoir covers an AINSI E-52100 steel test disk. A test ball made of AINSI E-52100 steel is mounted over the test reservoir containing sample and test disk and the test reservoir is brought to the test temperature of 80° C. When the reservoir has reached the test temperature, the test ball is lowered onto the disk, and the test load applied. The ball is then moved over the disk in a reciprocating manner over the stationary disk. The temperature of the reservoir is increased from 80° C. to 350° C. over a 30 minute duration, and the friction force between the specimens and the contact resistance value are measured periodically. Lower friction force, indicating a lower coefficient of friction between the samples, is preferred. A higher contact resistance value, indicating a larger surface layer film thickness, is preferred. The final friction force and contact resistance value are the average over the test duration.

The Marine HFRR Wear Test was applied to some of the marine cylinder lubricants set forth in Tables I-III. The results of the test are shown in Tables IV-VI.

TABLE IV

| 70 TBN Cylinder Lubricants Marine HFRR Wear Test Results | Ex. 2 | Ex. 3 | Ex. 5 | Ex. 6 |
|---|---|---|---|---|
| Esso 150N (Group I), wt. % | — | 38.4 | — | — |
| Esso 600N (Group I), wt. % | 76.8 | — | — | — |
| Chevron 110RLV (Group II), wt. % | — | — | — | 34.8 |
| Chevron 600R (Group II), wt. % | — | — | 76.8 | — |
| Esso Core 2500 (brightstock), wt. % | — | 38.4 | — | 42 |
| Viscosity @ 100° C., cSt | 15.9 | 15.9 | 15.6 | 15.5 |
| Friction force | 0.109 | 0.111 | 0.110 | 0.111 |
| Contact resistance value, % of standard | 96 | 67 | 64 | 70 |

TABLE V

| 40 TBN Cylinder Lubricants Marine HFRR Wear Test Results | Ex. 8 | Ex. 9 | Ex. 11 | Ex. 12 |
|---|---|---|---|---|
| Esso 150N (Group I), wt. % | — | 43.7 | — | — |
| Esso 600N (Group I), wt. % | 86.7 | — | — | — |
| Chevron 110RLV (Group II), wt. % | — | — | — | 39.2 |
| Chevron 600R (Group II), wt. % | — | — | 86.7 | — |
| Esso Core 2500 (brightstock), wt. % | — | 43.0 | — | 47.5 |
| Viscosity @ 100° C., cSt | 14.0 | 13.8 | 13.8 | 13.5 |
| Friction force | 0.106 | 0.108 | 0.107 | 0.107 |
| Contact resistance value, % of standard | 59 | 40 | 67 | 63 |

TABLE VI

| 10 TBN Cylinder Lubricants Marine HFRR Wear Test Results | Ex. 14 | Ex. 15 | Ex. 17 | Ex. 18 |
|---|---|---|---|---|
| Esso 150N (Group I), wt. % | — | 46.7 | — | — |
| Esso 600N (Group I), wt. % | 96.7 | — | — | — |
| Chevron 110RLV (Group II), wt. % | — | — | — | 41.7 |
| Chevron 600R (Group II), wt. % | — | — | 96.7 | — |
| Esso Core 2500 (brightstock), wt. % | — | 50.0 | — | 55.0 |
| Viscosity @ 100° C., cSt | 12.5 | 12.7 | 12.4 | 12.6 |
| Friction force | 0.228 | 0.238 | 0.206 | 0.232 |
| Contact resistance value, % of standard | 3 | 3 | 5 | 3 |

It is apparent that the marine cylinder lubricants of Table VI have much poorer Marine HFRR Wear test performance than the marine cylinder lubricants of Tables IV and V. In addition, although the contact resistance values for the Group I-containing 70 TBN and 40 TBN marine cylinder lubricants of Examples 2, 6, 8, and 12 deteriorate markedly as the viscosity decreases from about 16 cSt to about 14 cSt, the contact resistance values for the Group II-containing 70 TBN and 40 TBN marine cylinder lubricants of the present invention, i.e., Examples 5, 6, 11, and 12, actually increase or remain relatively the same, suggesting improved or consistent wear performance. The data show that the low viscosity Group II-containing marine cylinder lubricants of the present invention have superior wear performance over the entire viscosity range from about 13 cSt to about 16 cSt.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A marine cylinder lubricant comprising a major amount of a Group II basestock, wherein the marine cylinder lubricant has a kinematic viscosity at 100° C. of from 13 to about 16.2 cSt and a TBN of from about 40 to about 70; and further wherein the marine cylinder lubricant is substantially free of a bright stock and substantially free of a Group I basestock.

2. The marine cylinder lubricant of claim 1, having a kinematic viscosity at 100° C. of from about 13.25 to about 16.2 cSt.

3. The marine cylinder lubricant of claim 1, having a kinematic viscosity at 100° C. of from about 13.50 to about 16.2 cSt at 100° C.

4. The marine cylinder lubricant of claim 1, further comprising a marine cylinder engine lubricating oil composition additive selected from the group consisting of an antioxidant, ashless dispersant, detergent, anti-wear agents, rust inhibitor, dehazing agent, demulsifying agent, metal deactivating agent, friction modifier, pour point depressant, antifoaming agent, co-solvent, package compatibiliser, corrosion-inhibitor, dyes, extreme pressure agent and mixtures thereof.

5. A method for maintaining wear performance of a marine cylinder lubricant used in a cylinder of a 2-stroke crosshead marine diesel engine comprising lubricating the cylinder with a marine cylinder lubricant comprising a major amount of a Group II basestock, wherein the marine cylinder lubricant has a kinematic viscosity at 100° C. of from 13 to about 16.2 cSt and a TBN of from about 40 to about 70; and further wherein said marine cylinder lubricant is substantially free of a bright stock and substantially free of a Group I basestock.

6. The method of claim 5, wherein the marine cylinder lubricant further comprises a marine cylinder engine lubricating oil composition additive selected from the group consisting of an antioxidant, ashless dispersant, detergent, anti-wear agent, rust inhibitor, dehazing agent, demulsifying agent, metal deactivating agent, friction modifier, pour point depressant, antifoaming agent, co-solvent, package compatibiliser, corrosion-inhibitor, dye, extreme pressure agent and mixtures thereof.

* * * * *